US010207507B2

(12) United States Patent
Furukawa et al.

(10) Patent No.: US 10,207,507 B2
(45) Date of Patent: Feb. 19, 2019

(54) INKJET RECORDING APPARATUS

(71) Applicant: KYOCERA Document Solutions Inc., Osaka-shi, Osaka (JP)

(72) Inventors: Noriaki Furukawa, Osaka (JP); Takashi Somete, Osaka (JP); Yasutaka Inui, Osaka (JP); Masanobu Maeshima, Osaka (JP); Takuma Araki, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/826,185

(22) Filed: Nov. 29, 2017

(65) Prior Publication Data

US 2018/0154640 A1 Jun. 7, 2018

(30) Foreign Application Priority Data

Dec. 1, 2016 (JP) ..... 2016-234022

(51) Int. Cl.
*B41J 2/165* (2006.01)

(52) U.S. Cl.
CPC ..... *B41J 2/16552* (2013.01); *B41J 2/16505* (2013.01); *B41J 2/16517* (2013.01); *B41J 2/16535* (2013.01); *B41J 2002/16558* (2013.01); *B41J 2002/16591* (2013.01)

(58) Field of Classification Search
CPC B41J 2/16552; B41J 2/16505; B41J 2/16535; B41J 2/16517; B41J 2002/16591; B41J 2002/16558
See application file for complete search history.

(56) References Cited

U.S. PATENT DOCUMENTS

| | | | | |
|---|---|---|---|---|
| 6,257,697 | B1 | 7/2001 | Kurata | |
| 2007/0279452 | A1 | 12/2007 | Mizoguchi et al. | |
| 2018/0154639 | A1 * | 6/2018 | Furukawa | B41J 2/16505 |

FOREIGN PATENT DOCUMENTS

| | | | | |
|---|---|---|---|---|
| JP | H07314732 | A | 12/1995 | |
| JP | 2004-083496 | * | 4/2007 | B41J 2/165 |
| JP | 2007083496 | A | 4/2007 | |
| JP | 2007296779 | A | 11/2007 | |
| JP | 2013159008 | A | 8/2013 | |

* cited by examiner

*Primary Examiner* — Geoffrey S Mruk
(74) *Attorney, Agent, or Firm* — Alleman Hall Creasman & Tuttle LLP

(57) ABSTRACT

An inkjet recording apparatus includes an ink ejection surface and a cleaning liquid nozzle. The ink ejection surface has an ink ejection port through which ink is ejected. The cleaning liquid nozzle has a cleaning liquid supply port through which cleaning liquid for cleaning the ink ejection surface is supplied. In the cleaning liquid nozzle, a concave meniscus is formed on a surface of the cleaning liquid.

10 Claims, 19 Drawing Sheets

INKJET RECORDING APPARATUS

INCORPORATION BY REFERENCE

This application is based upon and claims the benefit of priority from the corresponding Japanese Patent Application No. 2016-234022 filed on Dec. 1, 2016, the entire contents of which are incorporated herein by reference.

BACKGROUND

The present disclosure relates to an inkjet recording apparatus for recording an image on a recording medium by causing ink to be ejected on the recording medium from recording heads, and, in particular, to an inkjet recording apparatus that can clean ink ejection surfaces of the recording heads.

There is known a typical inkjet recording apparatus that is configured to record an image on a recording medium such as a paper sheet by causing ink to be ejected from nozzles of recording heads. In this inkjet recording apparatus, when ink droplets are ejected from the nozzles, the ink that scattered around the nozzles and the ink that overflowed, may adhere to the ink ejection surfaces. In that case, the ink that adhered to the peripherals of the nozzles may shift the ink ejection direction from an intended direction, or change the amount of ejected ink from an intended amount, resulting in an image recording failure.

On the other hand, there is known a technique in which a cleaning liquid supply port for supplying a cleaning liquid is provided in the ink ejection surface of the recording head, and the ink ejection surface is wiped by a cleaning member by using the cleaning liquid.

SUMMARY

An inkjet recording apparatus according to an aspect of the present disclosure includes an ink ejection surface and a cleaning liquid nozzle. The ink ejection surface has an ink ejection port through which ink is ejected. The cleaning liquid nozzle has a cleaning liquid supply port through which cleaning liquid for cleaning the ink ejection surface is supplied. In the cleaning liquid nozzle, a concave meniscus is formed on a surface of the cleaning liquid.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

In the following, an inkjet recording apparatus X1 (hereinafter referred to as a "recording apparatus X1") according to the embodiment of the present disclosure is described with reference to FIG. 1 and FIG. 2. It is noted that FIG. 1 shows a state where a conveyance unit 5 of the recording apparatus X1 is disposed at a recording position such that a recording portion 3 can perform printing, and FIG. 2 shows a state where the conveyance unit 5 is disposed at a maintenance position that is a predetermined distance below the recording position.

Figure 1:
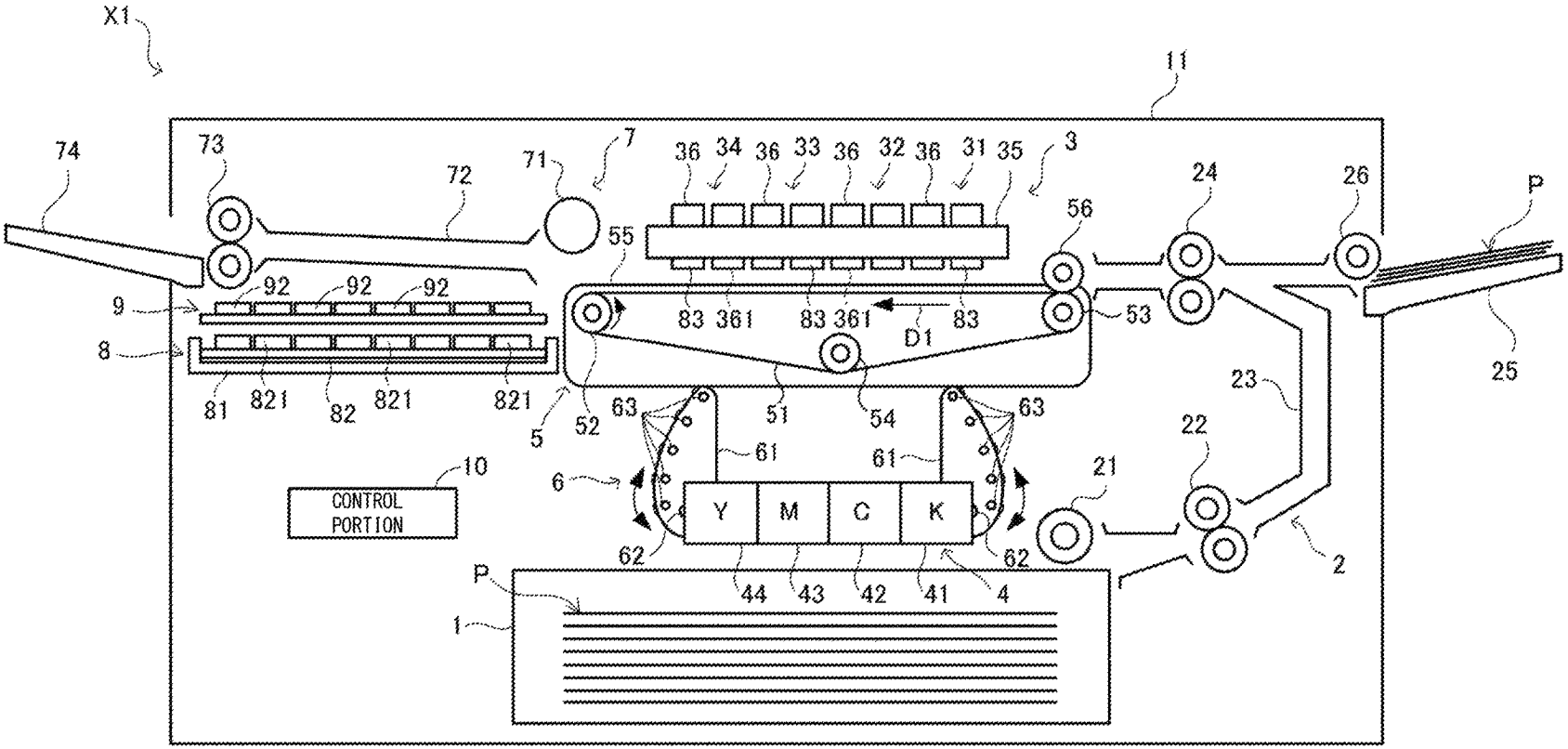
FIG. 1 is a schematic cross-sectional view showing a configuration of an inkjet recording apparatus according to an embodiment of the present disclosure.
Figure 2:
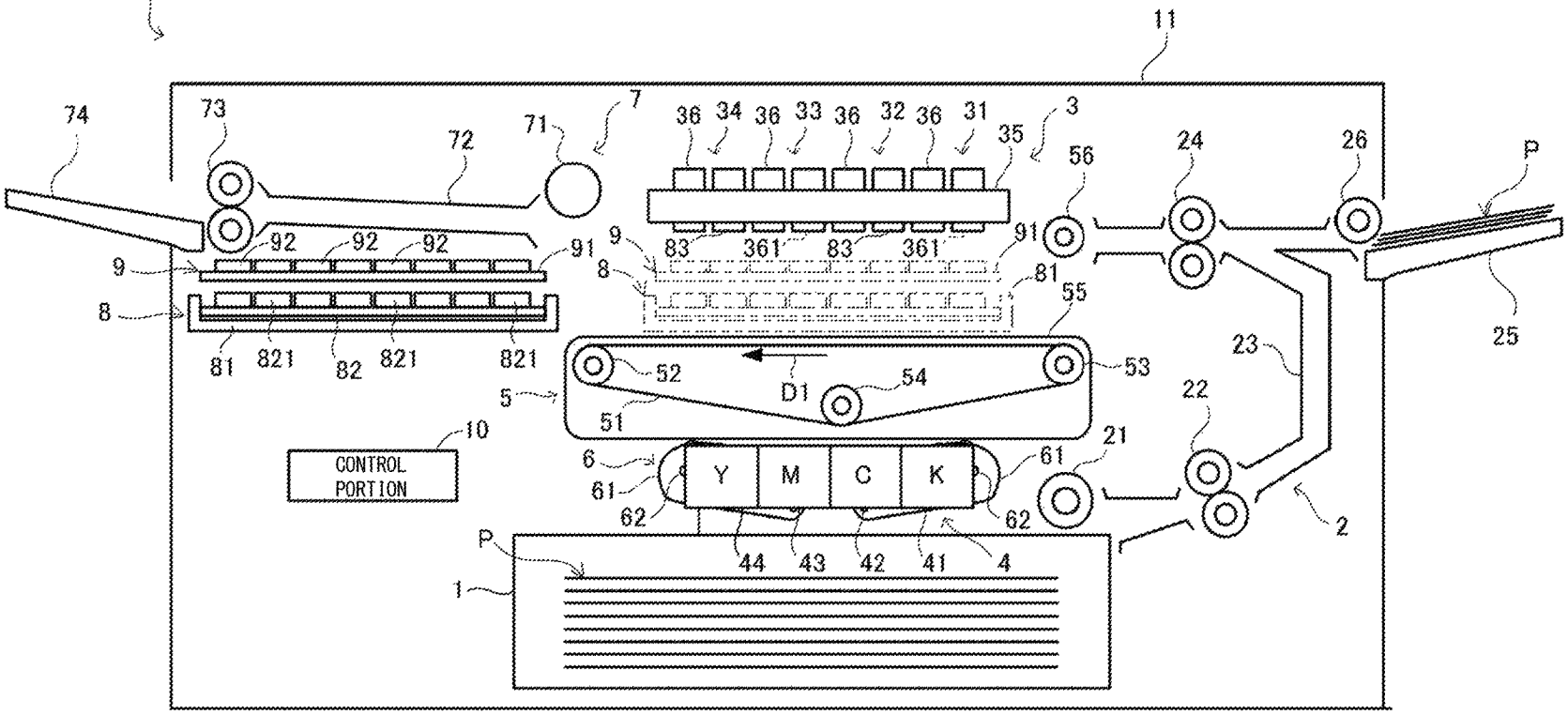
FIG. 2 is a schematic cross-sectional view showing a configuration of the inkjet recording apparatus.

As shown in FIG. 1, the recording apparatus X1 includes a sheet feed cassette 1, a sheet feed portion 2, a recording portion 3, an ink tank portion 4, the conveyance unit 5, a lifting/lowering mechanism 6, a sheet discharge portion 7, a cleaning device 8, a cap device 9, a control portion 10, and a main body frame 11 that stores or supports these components.

The recording apparatus X1 is a printer that executes a print process based on input image data. It is noted that the inkjet recording apparatus according to the present disclosure is not limited to a printer, but is applicable to, for example, a copier, a facsimile device, and a multifunction peripheral.

The sheet feed cassette 1 stores paper sheets P which are a target of printing in the recording apparatus X1. Of course, printing target is not limited to paper, but may be a recording medium such as an OHP sheet or a cloth sheet.

The sheet feed portion 2 includes a pick-up roller 21, a conveyance roller 22, a conveyance path 23, a registration roller 24, a manual feeder 25, and a sheet feed roller 26. The pick-up roller 21 picks up the paper sheets P one by one from the sheet feed cassette 1. The conveyance roller 22 and the conveyance path 23 convey each paper sheet P picked up by the pick-up roller 21, to the registration roller 24. The registration roller 24 conveys the paper sheet P to the recording portion 3 at a predetermined conveyance timing (image writing timing). The manual feeder 25 and the sheet feed roller 26 are used to supply paper sheets P from outside.

The recording portion 3 includes line heads 31, 32, 33, and 34 that respectively correspond to colors black, cyan, magenta, and yellow. That is, the recording apparatus X1 is a so-called line-head-type inkjet recording apparatus. In addition, the recording portion 3 includes a head frame 35 that supports the line heads 31 to 34. The head frame 35 is supported by the main body frame 11. In the present embodiment, the recording portion 3 includes the four line heads 31 to 34 in correspondence with the above-mentioned four colors. However, the number of line heads is not limited to four, but may be any number that is one or more.

Figure 3:
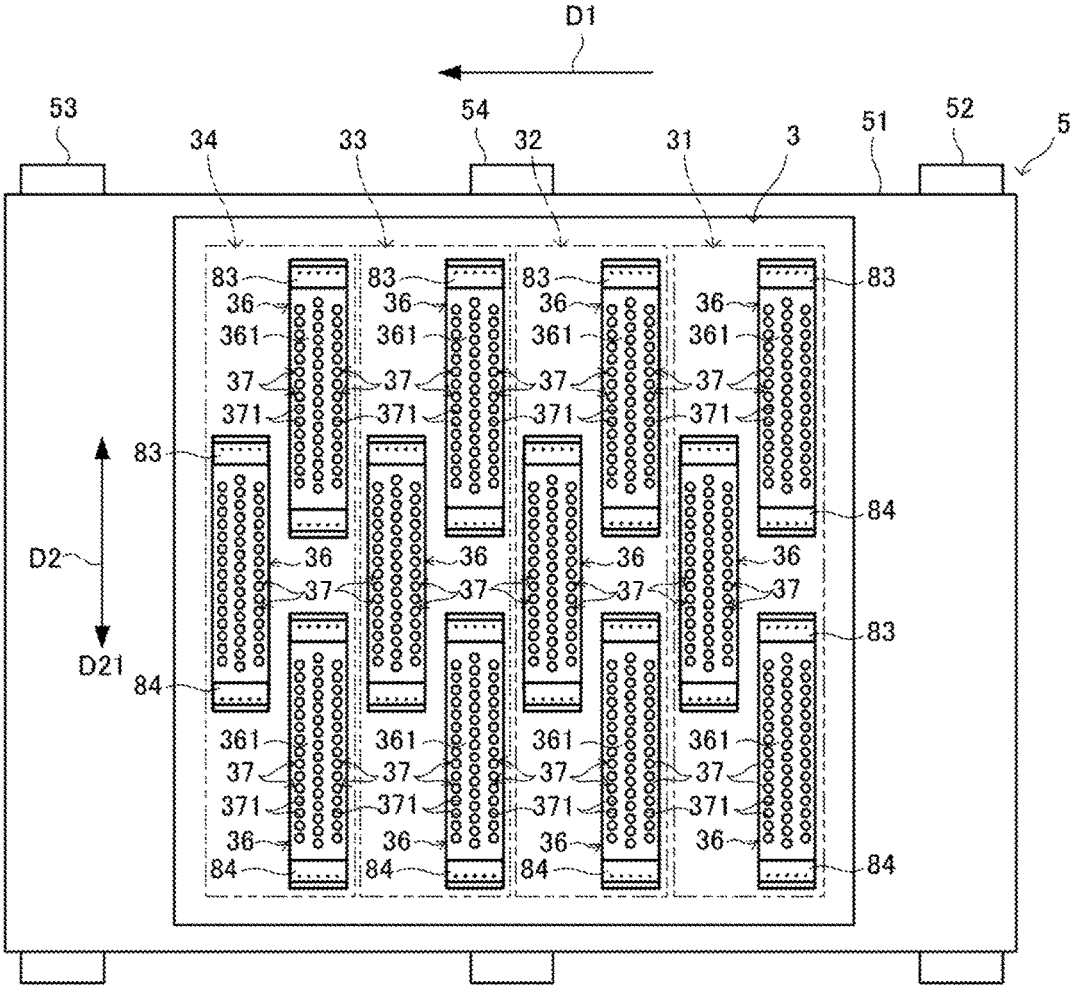
FIG. 3 is a plan view of a recording portion of the inkjet recording apparatus viewed from below.
Figure 4:
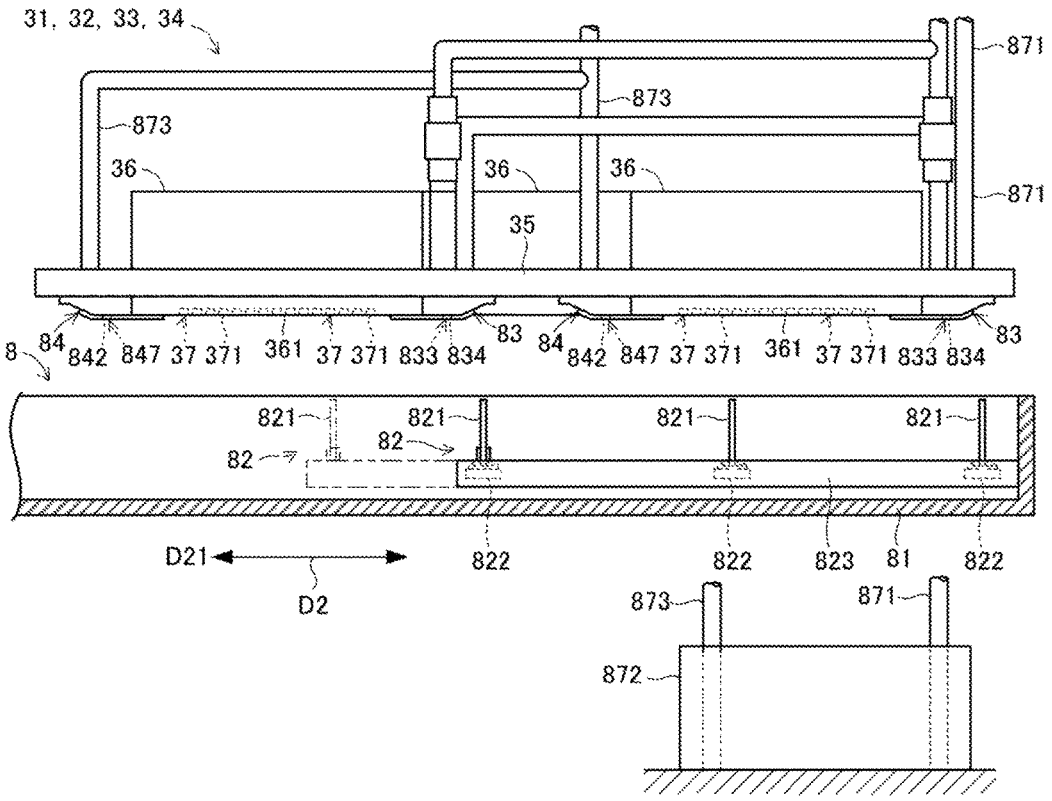
FIG. 4 is a partially broken side view showing a state where an ink tray and a wiper unit of a cleaning device of the inkjet recording apparatus are disposed below the recording portion.

Here, FIG. 3 shows the recording portion 3 viewed from the upper side of FIG. 1. FIG. 4 is a partially broken side view showing a state where an ink tray 81 and a wiper unit 82 of the cleaning device 8 of the recording apparatus X1 are disposed below the recording portion 3.

As shown in FIG. 3 and FIG. 4, the line heads 31 to 34 are elongated in a width direction D2 (the width direction of the paper sheet P) that is vertical to a conveyance direction D1 in which the paper sheets P are conveyed. The width of each of the line heads 31 to 34 corresponds to the maximum width of the paper sheets P that can be conveyed. The line heads 31 to 34 are fixed to the head frame 35 in a state where they are arranged at predetermined intervals along the conveyance direction D1 in which the paper sheets P are conveyed. Each of the line heads 31 to 34 includes a plurality of recording heads 36.

Each of the recording heads 36 includes a plurality of ink nozzles 37, and each of the ink nozzles 37 includes an ink ejection port 371 through which ink is ejected. The lower surface of each recording head 36 is an ink ejection surface 361 in which the ink ejection port 371 is provided. In the present embodiment, in the line head 31, three recording heads 36 are arranged in zigzag along the width direction D2. In addition, in each of the other line heads 32 to 34, as in the line head 31, three recording heads 36 are arranged in zigzag along the width direction D2.

The recording portion 3 records an image on a paper sheet P by causing the ink to be ejected from the ink nozzles 37 of the recording heads 36 onto the paper sheet P conveyed by the conveyance unit 5. As an ink ejection system of the line heads 31 to 34, a piezo system or a thermal system is adoptable for example, wherein in the piezo system, piezo elements are used to eject the ink, and in the thermal system, air bubbles are generated by heating to eject the ink.

As shown in FIG. 1, the ink tank portion 4 includes ink tanks 41, 42, 43, and 44 in which ink corresponding to the colors black, cyan, magenta, and yellow is stored, respectively. The ink tanks 41 to 44 are respectively connected to the line heads 31 to 34 of the corresponding colors by ink tubes (not shown). The ink is supplied from the ink tanks 41 to 44 to the line heads 31 to 34, respectively. In the ink tanks 41 to 44, air is present on the ink, and the liquid level of the ink in the ink tanks 41 to 44 is adjusted so as to be lower than the ink ejection surfaces 361 of the line heads 31 to 34. The ink used here is a mixture of solvent or water with a colorant.

The conveyance unit 5 is disposed below the line heads 31 to 34. The conveyance unit 5 conveys the paper sheet P in a state where the paper sheet P faces the ink ejection surfaces 361. Specifically, the conveyance unit 5 includes a paper sheet conveyance belt 51, stretching rollers 52 to 54, and a conveyance frame 55, wherein the paper sheet P is placed on the paper sheet conveyance belt 51, the paper sheet conveyance belt 51 is stretched among the stretching rollers 52 to 54, and the conveyance frame 55 supports these members. It is noted that the interval between the paper sheet conveyance belt 51 and the ink ejection surfaces 361 is adjusted so that during an image recording, the interval between the paper sheet P and the ink ejection surfaces 361 becomes, for example, 1 (one) mm.

The stretching roller 52 is coupled with a rotation shaft of a motor (not shown). When the motor is driven and the stretching roller 52 is rotated counterclockwise, the paper sheet conveyance belt 51 moves rotationally so as to convey the paper sheet P in the conveyance direction D1. As the paper sheet conveyance belt 51 moves rotationally in such a manner, the paper sheet P fed from the sheet feed portion 2 is conveyed through the recording portion 3 toward the sheet discharge portion 7. It is noted that the conveyance unit 5 also includes a suction unit (not shown) for sucking air through a lot of through holes formed in the paper sheet conveyance belt 51 so that the paper sheet P is adsorbed on the paper sheet conveyance belt 51. In addition, a pressure roller 56 is provided at a position facing the stretching roller 53 so as to press the conveyed paper sheet P against the paper sheet conveyance belt 51.

The lifting/lowering mechanism 6 supports the conveyance unit 5 from below, and lifts and lowers the conveyance unit 5 in an up/down direction below the line heads 31 to 34. That is, the lifting/lowering mechanism 6 causes the conveyance unit 5 and the line heads 31 to 34 to separate from and approach each other by causing the conveyance unit 5 to move relative to the line heads 31 to 34. Specifically, the lifting/lowering mechanism 6 causes the conveyance unit 5 to move between a recording position (the position shown in FIG. 1) and a maintenance position (the position shown in FIG. 2), wherein when the conveyance unit 5 is at the recording position, the recording portion 3 can perform a printing, and the maintenance position is a predetermined distance below the recording position.

The lifting/lowering mechanism 6 includes four eccentric cams 61, rotation shafts 62, and bearing groups 63, wherein the four eccentric cams 61 are provided in correspondence with four corners of a bottom surface of the conveyance unit 5. The eccentric cams 61 are axially supported by the rotation shafts 62 so as to be rotatable, and the rotation shafts 62 are coupled with rotation shafts of a motor (not shown). Each of the bearing groups 63 includes a plurality of bearings each of which is supported by the eccentric cam 61 in a state where a part of it projects outward from an outer circumferential edge of the eccentric cam 61. The conveyance unit 5 is supported from below by bearings that are highest in position in the vertical direction among the plurality of bearings of the bearing groups 63.

In the lifting/lowering mechanism 6, the eccentric cams 61 are rotated as the rotation shafts 62 are rotationally driven by the motor (not shown). At this time, with the rotation of the eccentric cams 61, the bearings that are highest in position in the vertical direction, among the bearings of the bearing groups 63, change in sequence. As a result, the bearings supporting the conveyance unit 5 from below change in sequence, and the conveyance unit 5 is lifted and lowered in the vertical direction.

For example, in FIG. 1, when the eccentric cams 61 on the left side are rotated clockwise and the eccentric cams 61 on the right side are rotated counterclockwise, the conveyance unit 5 is lowered gradually. In addition, in FIG. 2, when the eccentric cams 61 on the left side are rotated counterclockwise and the eccentric cams 61 on the right side are rotated clockwise, the conveyance unit 5 is lifted gradually.

FIG. 1 shows a state where the conveyance unit 5 is supported by bearings that are farthest from the rotation shafts 62 among the plurality of bearings of the bearing groups 63. In this state, the conveyance unit 5 is at the maximum height in the vertical direction and is at the recording position where the conveyance unit 5 is closest to the line heads 31 to 34. When the conveyance unit 5 is at the recording position in this way, the recording apparatus X1 can perform a printing operation.

FIG. 2 shows a state where the conveyance unit 5 is supported by bearings that are, among the plurality of bearings of the bearing groups 63, closest to the rotation shafts 62. In this state, the conveyance unit 5 is at the minimum height in the vertical direction and is at the maintenance position where the conveyance unit 5 is farthest from the line heads 31 to 34. When the conveyance unit 5 is at the maintenance position, the user can remove paper sheets P that have been caught in the conveyance unit 5. In addition, when the conveyance unit 5 is at the maintenance position, the cleaning device 8 can perform a purging operation and a cleaning operation. When the conveyance unit 5 is at the maintenance position, it is also possible to cause the cap device 9 to cover a first cleaning liquid supply port 834 (an example of the cleaning liquid supply port of the present disclosure), a second cleaning liquid supply port 847, and the ink ejection port 371, wherein the first cleaning liquid supply port 834, the second cleaning liquid supply port 847, and the ink ejection port 371 are described below.

The sheet discharge portion 7 is provided on the downstream side of the recording portion 3 in the conveyance direction D1. The sheet discharge portion 7 includes a drying device 71, a conveyance path 72, a sheet discharge roller 73, and a sheet discharge tray 74. The drying device 71 dries the ink that has been fixed to the paper sheet P, by, for example, blowing air to the paper sheet P. The paper sheet P dried by the drying device 71 is fed to the conveyance path 72, and is discharged onto the sheet discharge tray 74 by the sheet discharge roller 73.

The cleaning device 8 is configured to restore the function of the recording heads 36 of the line heads 31 to 34. As shown in FIG. 4, the cleaning device 8 includes an ink tray 81, a wiper unit 82, a plurality of first cleaning liquid supplying portions 83 (an example of the cleaning liquid supplying portion of the present disclosure), and a plurality of second cleaning liquid supplying portions 84.

The ink tray 81 receives the ink ejected from the ink nozzles 37 of the recording heads 36. The ink tray 81 is supported by a first moving mechanism (not shown) so as to move in the horizontal direction (in the left-right direction in FIG. 1). The first moving mechanism is a well-known drive mechanism that moves the ink tray 81 in the horizontal direction by using, for example, a rack and pinion mechanism that converts a rotary motion of a gear coupled with a rotation shaft of a motor to a linear motion. At a normal time (printable time), the ink tray 81 is disposed at a first retracted position that is on the downstream side of the recording portion 3 in the conveyance direction D1. When an instruction for performing a cleaning operation is input, or when another condition for performing the cleaning operation is satisfied, the ink tray 81 is moved by the first moving mechanism to a space that is generated between the conveyance unit 5 and the line heads 31 to 34 after the conveyance unit 5 is lowered to the maintenance position by the lifting/lowering mechanism 6 (see the position represented by a two-dot chain line in FIG. 2). In addition, the ink tray 81 is supported so as to be lifted and lowered in a vertical direction (the up-down direction in FIG. 1). After the ink tray 81 moves to the space between the conveyance unit 5 and the line heads 31 to 34, the ink tray 81 is lifted as the conveyance unit 5 is lifted by the lifting/lowering mechanism 6 from the maintenance position by a predetermined distance.

In the wiper unit 82, a plurality of wiper members 821 (an example of the cleaning member of the present disclosure) are supported by a pair of side frames 823 via a plurality of stays 822, wherein the wiper members 821 are configured to clean the ink that has adhered to the ink ejection surfaces 361. The wiper unit 82 is configured to move along the width direction D2. As a result, the plurality of wiper members 821 can move along the width direction D2 from the first cleaning liquid supplying portions 83 toward the second cleaning liquid supplying portions 84 while in contact with the ink ejection surfaces 361 (see FIG. 12 to FIG. 16).

The direction directed from the first cleaning liquid supplying portions 83 toward the second cleaning liquid supplying portions 84 is an example of the moving direction of the present disclosure. Hereinafter, the direction directed from the first cleaning liquid supplying portions 83 toward the second cleaning liquid supplying portions 84 is referred to as a specific width direction D21. As the wiper members 821 move along the specific width direction D21, the wiper members 821 clean the ink ejection surfaces 361 by a first cleaning liquid 831 (see FIG. 8) supplied from the first cleaning liquid supplying portions 83.

Each of the plurality of wiper members 821 is an elastic plate formed from, for example, elastomer so as to have a thickness of 1 mm to 2 mm. As the elastomer, for example, urethane rubber, ethylene propylene diene rubber (EPDM), nitrile rubber (NBR), styrene rubber (SBR), chloroprene rubber, silicone rubber, or fluororubber may be used.

Figure 5:
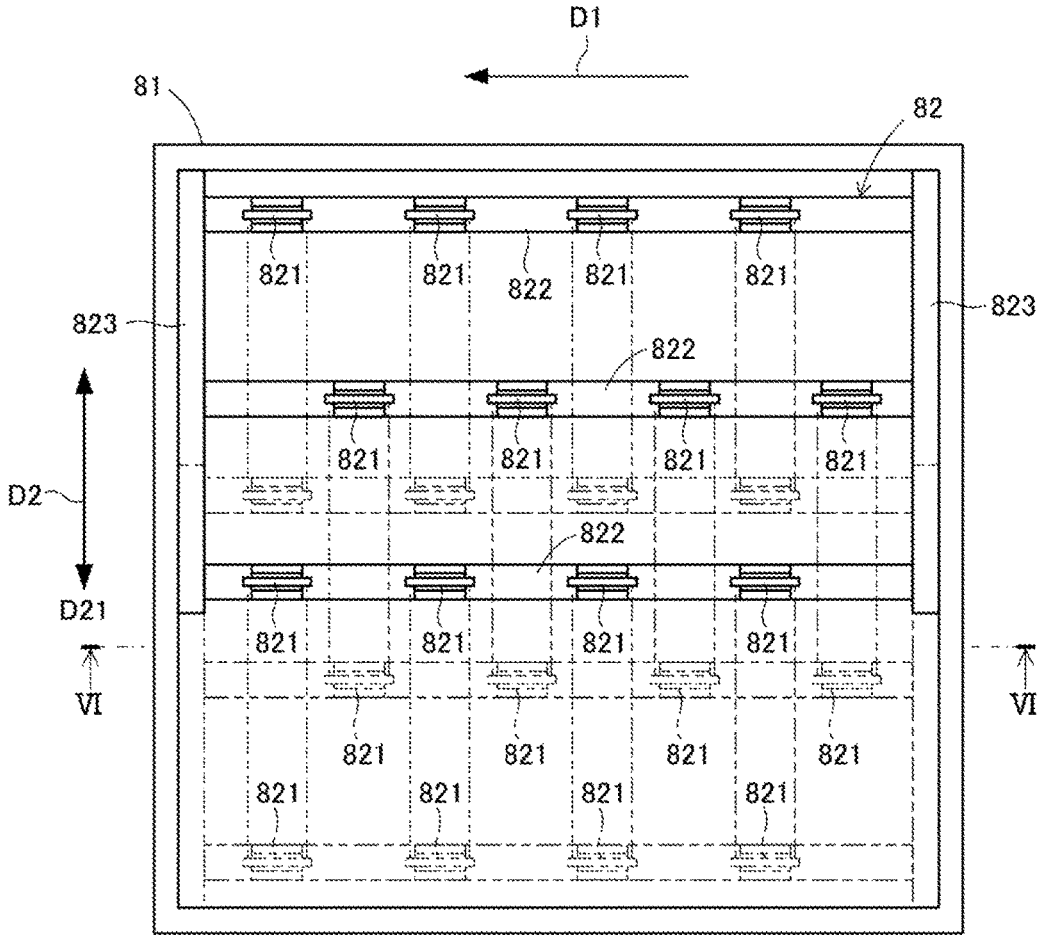
FIG. 5 is a plan view for explaining the wiper unit.
Figure 6:
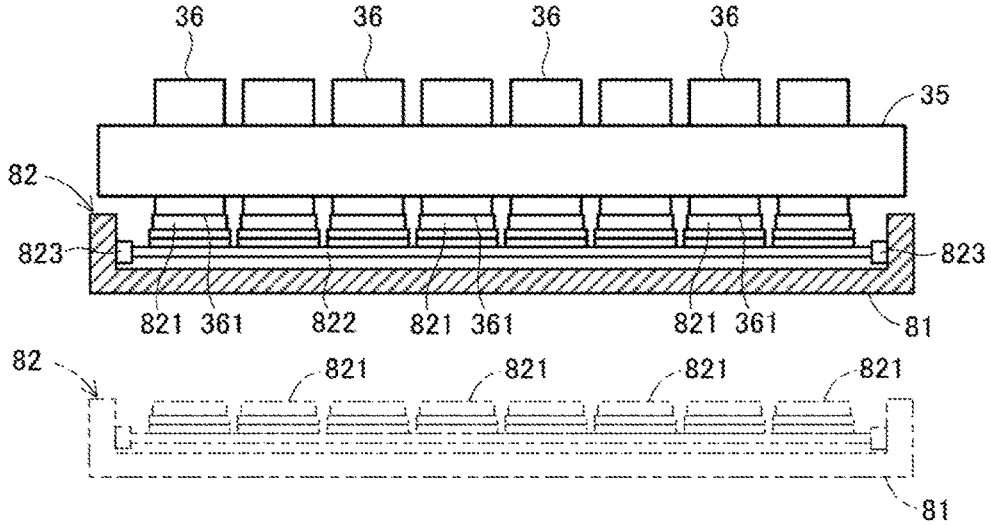
FIG. 6 is a cross-sectional view taken along a VI-VI cut line shown in FIG. 5.

As shown in FIG. 5 and FIG. 6, the plurality of stays 822 extend along the conveyance direction D1 and are coupled with the pair of side frames 823. In the present embodiment, three stays 822 are provided. To each of the stays 822, four wiper members 821 are fixed. That is, the number of the plurality of wiper members 821 are twelve in correspondence with the twelve recording heads 36.

The pair of side frames 823 can be reciprocally moved along the width direction D2 by a second moving mechanism (not shown). The second moving mechanism is a well-known drive mechanism such as a rack and pinion mechanism. For example, with a configuration where the side frames 823 that function as racks are given a rotational force via pinion gears (not shown), the side frames 823 move reciprocally along the width direction D2. This allows the whole wiper unit 82 including the plurality of wiper members 821 to move reciprocally along the width direction D2.

Figure 7:
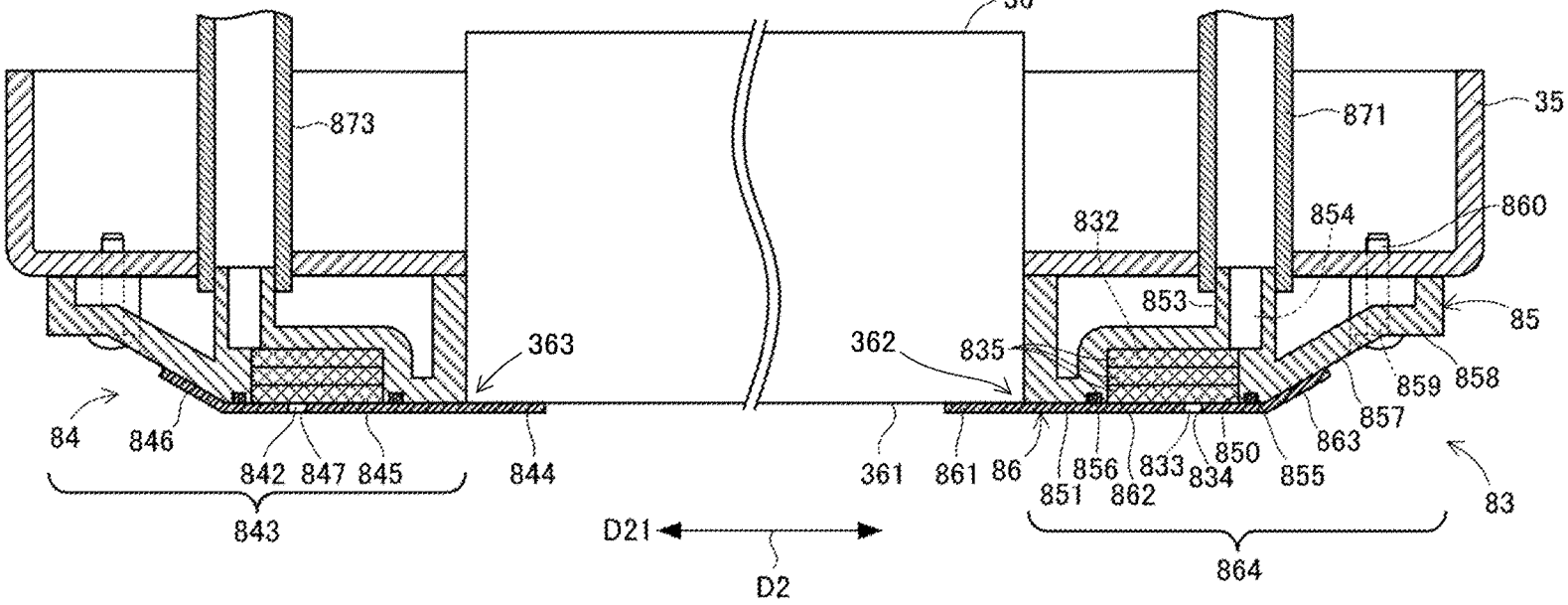
FIG. 7 is a partial cross-sectional view for explaining a first cleaning liquid supplying portion and a second cleaning liquid supplying portion.
Figure 8:
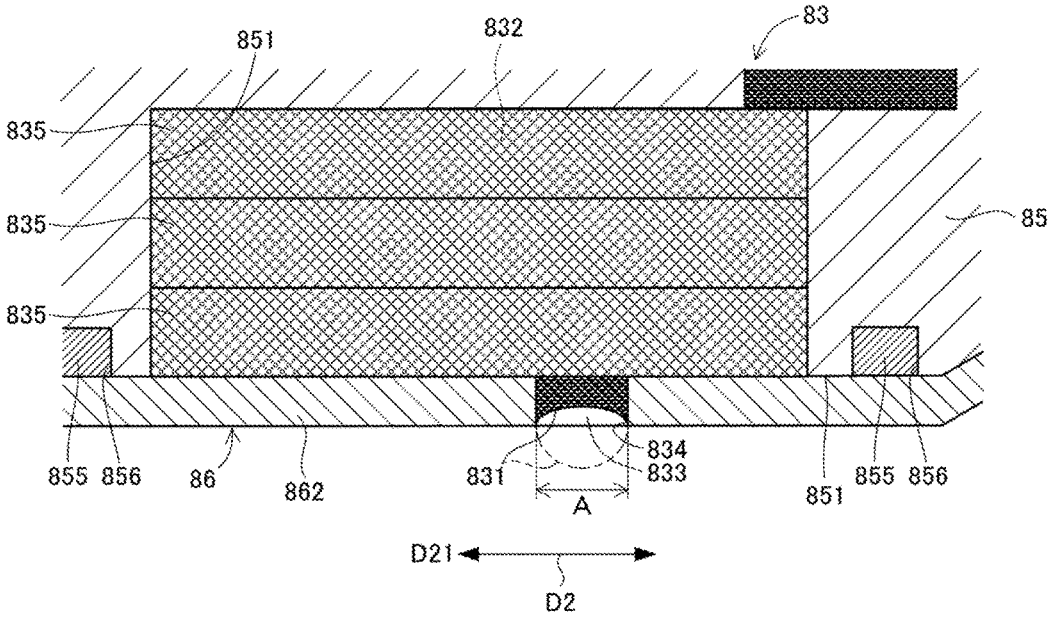
FIG. 8 is a cross-sectional view showing an enlargement of a main part of the first cleaning liquid supplying portion.

As shown in FIG. 7 and FIG. 8, the plurality of first cleaning liquid supplying portions 83 supply the first cleaning liquid 831 (an example of the cleaning liquid of the present disclosure) for cleaning the ink ejection surfaces 361. During the cleaning of the ink ejection surfaces 361 by the wiper members 821, the first cleaning liquid supplying portions 83 supply the first cleaning liquid 831 stored in a storage space 832, via first cleaning liquid nozzles 833 that are communicated with the storage space 832. Here, a liquid generated by removing the colorant from the ink can be used as the first cleaning liquid 831. That is, a liquid mainly composed of the solvent or the water can be used as the first cleaning liquid 831. In addition, a surface active agent, an antiseptic and antifungal agent or the like may be added to the first cleaning liquid 831, as necessary.

As shown in FIG. 8, when cleaning of the ink ejection surfaces 361 is being performed, the first cleaning liquid 831 is supplied in a state (the state represented by the two-dot chain line in FIG. 8) where it projects, in a semispherical shape, from the first cleaning liquid supply ports 834 provided in the first cleaning liquid nozzles 833. On the other hand, when cleaning of the ink ejection surfaces 361 is not being performed, a concave meniscus is formed in each of the first cleaning liquid nozzles 833 (the state represented by the solid line in FIG. 8). Here, it is possible to form the concave meniscus by adjusting an internal diameter A of the first cleaning liquid nozzle 833 and a negative pressure that is applied by the storage space 832 to the inside of the first cleaning liquid nozzle 833.

The internal diameter A of the first cleaning liquid nozzle 833 is, for example, 100 μm or smaller. When the internal diameter A of the first cleaning liquid nozzle 833 is set to 100 μm or smaller, the concave meniscus is formed by a capillary force that is applied to the inside of the first cleaning liquid nozzle 833. To form the concave meniscus, the internal diameter A of the first cleaning liquid nozzle 833 is preferably small. The internal diameter A of the first cleaning liquid nozzle 833 is preferably 75 μm or smaller, and more preferably 50 μm or smaller. On the other hand, the internal diameter A of the first cleaning liquid nozzle 833 is preferably 10 μm or larger. When the internal diameter A of the first cleaning liquid nozzle 833 is smaller than 10 μm, processing of the first cleaning liquid nozzle 833 becomes difficult.

A plurality of porous members 835 having multiple fine pores are disposed in the storage space 832. When the porous members 835 are disposed in the storage space 832, the capillary force of the porous members 835 applies a negative pressure to the inside of the first cleaning liquid nozzle 833. In addition, when the porous members 835 are disposed in the storage space 832, the capillary force of the porous members 835 as well as the capillary force of the first cleaning liquid nozzle 833 applies a negative pressure to the inside of the first cleaning liquid nozzle 833. This makes it possible to form the concave meniscus suitably in the inside of the first cleaning liquid nozzle 833. With the capillary force of the porous members 835 added, it is possible to make the internal diameter A relatively large. When the internal diameter A of the first cleaning liquid nozzle 833 is large, the processability of the first cleaning liquid nozzle 833 is improved.

In the present embodiment, the porous members 835 are sheet-like, and three porous members 835 are stacked in the thickness direction (the up-down direction in FIG. 1). When a plurality of porous members 835 are stacked in this way, the capillary force of the porous members 835 can apply a negative pressure to the inside of the first cleaning liquid nozzle 833 more suitably. It is noted however that the porous members 835 is preferably disposed closer to the first cleaning liquid nozzle 833 so that the capillary force of the porous members 835 can apply the negative force efficiently to the inside of the first cleaning liquid nozzle 833. In addition, the number of the porous members 835 is not necessarily be three. For example, the porous members 835 is not necessarily be disposed in the storage space 832 as far as the capillary force of the first cleaning liquid nozzle 833 can form the concave meniscus.

The porous members 835 are formed from mesh sheets, for example. The mesh sheets are preferably metal mesh sheets formed from a metal such as stainless steel having excellent corrosion resistance. The average mesh diameter of the mesh sheets is preferably 10 μm or larger and 100 μm or smaller for a similar reason to the internal diameter A of the first cleaning liquid nozzle 833. In addition, each of the porous members 835 may be a sintered body of inorganic oxide powder (porous ceramic), a foamed resin body such as sponge, or a porous resin sheet.

Meanwhile, in a case where the cleaning liquid supply ports are provided in the ink ejection surface, it is difficult to supply a constant amount of cleaning liquid due to changes of the liquid level of the cleaning liquid in the tanks, for example. For example, when the liquid level of the cleaning liquid is high, a positive pressure acts on the cleaning liquid in the cleaning liquid supply ports. In that case, the cleaning liquid projects from the cleaning liquid supply ports, or is ejected during a recording of an image to a recording medium, and the cleaning liquid may be adhered to the recording medium. Conversely, when the liquid surface of the cleaning liquid is low, it may be difficult to supply the cleaning liquid of an amount sufficient to clean the ink ejection surface. In addition, there may be a case where an inkjet recording apparatus is provided with a mechanism for making constant the supply amount of the cleaning liquid. In that case, the inkjet recording apparatus has a complicated configuration. On the other hand, in the recording apparatus X1 according to the embodiment of the present disclosure, when the cleaning of the ink ejection surfaces 361 is not being performed, a concave meniscus of the first cleaning liquid 831 is formed in the inside of the first cleaning liquid nozzles 833 by using, for example, the capillary force of the first cleaning liquid nozzles 833 or the porous members 835. This makes it possible, with a simple configuration, to make constant the supply amount of the first cleaning liquid 831 in the recording apparatus X1.

Figure 9:
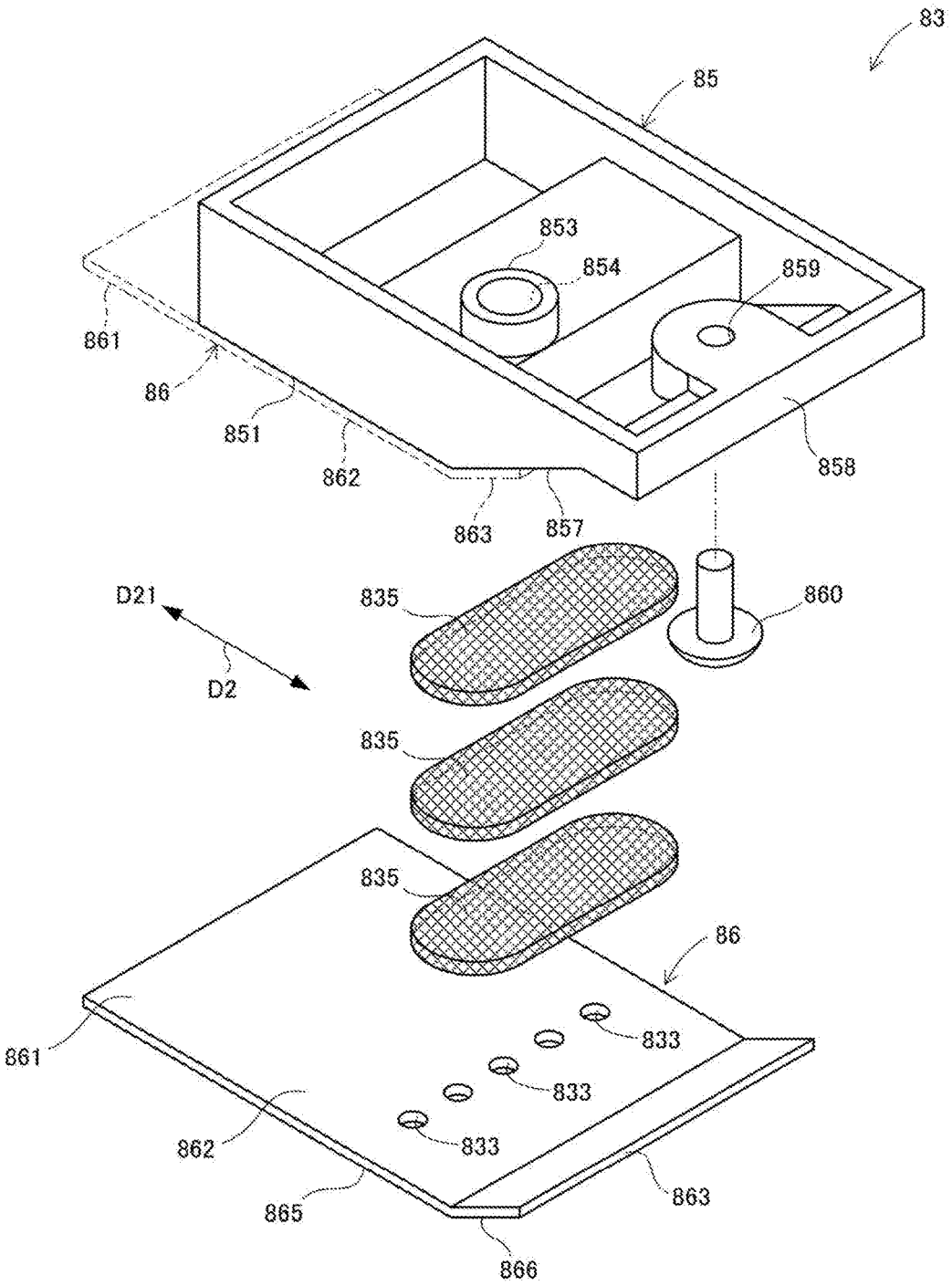
FIG. 9 is a disassembled perspective view of the first cleaning liquid supplying portion.
Figure 10:
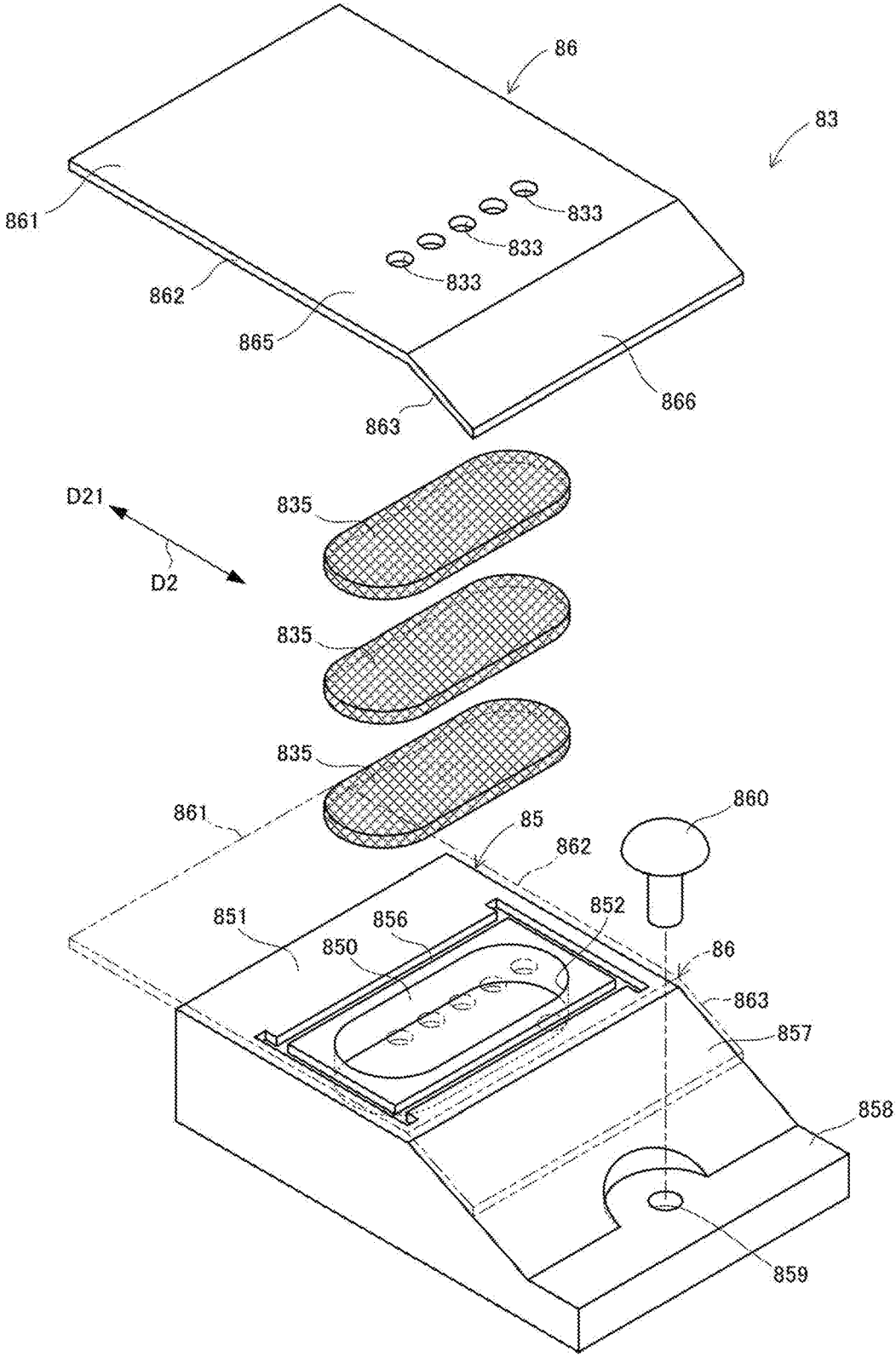
FIG. 10 is a disassembled perspective view of the first cleaning liquid supplying portion of FIG. 9 viewed from below.

As shown in FIG. 9 and FIG. 10, each of the first cleaning liquid supplying portions 83 includes a base body 85 (an example of the second member of the present disclosure) and a plate-like member 86 (an example of the first member of the present disclosure).

The base body 85 includes a concave portion 850 and a joint surface 851. The concave portion 850 includes a lower opening 852 in the joint surface 851. The concave portion 850 forms the storage space 832 together with the plate-like member 86, as described below. In addition, the inside of the concave portion 850 is communicated with an inner space 854 of a joint 853. The joint 853 is connected, via a tube 871, to a cleaning liquid holding portion 872 that holds the first cleaning liquid 831 (see FIG. 4). As a result, the first cleaning liquid 831 can be supplied to the inside of the concave portion 850 (namely, the storage space 832) from the cleaning liquid holding portion 872 via the tube 871 and the joint 853. It is noted that a pump (not shown) and a switching valve (not shown) are provided in the tube 871 so that the first cleaning liquid 831 can be supplied from the cleaning liquid holding portion 872 to the storage space 832.

The joint surface 851 is a surface with which a covering portion 862 of the plate-like member 86 is joined, wherein the covering portion 862 is described below. A groove portion 856 is formed on the joint surface 851, wherein the groove portion 856 is filled with an adhesive 855. The plate-like member 86 is joined with the base body 85 by the adhesive 855 filling the groove portion 856. In addition, the groove portion 856 is formed so as to surround the concave portion 850. Since the concave portion 850 is surrounded by the adhesive 855, the adhesive 855 functions as a sealing material. This makes it possible to prevent the first cleaning liquid 831 from being leaked from the storage space 832 through a gap between the joint surface 851 and the plate-like member 86.

In addition, in the base body 85, a through hole 859 is formed between an inclined portion 857 and a horizontal end portion 858. The through hole 859 is used when the base body 85 is fixed to the head frame 35 by a fixing member 860 such as a screw.

The plate-like member 86 has a bent shape and includes a protruding portion 861, the covering portion 862, and a bent portion 863. The plate-like member 86 is formed from a metal material such as stainless steel or a resin material such as polyimide, to have a thickness in a range of approximately 100 μm to 300 μm.

The protruding portion 861 protrudes from a lower end of the base body 85 toward the downstream in the specific width direction D21. Here, the base body 85 and the plate-like member 86 excluding the protruding portion 861 (namely, the covering portion 862 and the bent portion 863) constitute a main body portion 864. That is, the protruding portion 861 protrudes from the main body portion 864 toward the downstream in the specific width direction D21. On the other hand, each of the main body portions 864 is disposed on the upstream side of a corresponding recording head 36 in the specific width direction D21. As a result, the protruding portion 861 covers, from below, lower ends of side surfaces of the recording head 36 and the main body portion 864 that face each other in the width direction D2.

The covering portion 862 is joined with the joint surface 851 of the base body 85 by the adhesive 855 so as to cover the lower opening 852 of the concave portion 850. With this configuration, the storage space 832 is formed by the concave portion 850 of the base body 85 and the covering portion 862 of the plate-like member 86. In addition, in the covering portion 862, a plurality of first cleaning liquid nozzles 833 are arranged in line along the conveyance direction D1. That is, the lower surface of the covering portion 862 is a first cleaning liquid supply surface 865 (an example of the cleaning liquid supply surface of the present disclosure) in which a plurality of first cleaning liquid supply ports 834 are formed in line along the conveyance direction D1. In addition, since each of the main body portions 864 is disposed on the upstream side of a corresponding recording head 36 in the specific width direction D21, the plurality of first cleaning liquid supply ports 834 are disposed on the upstream side of the ink ejection ports 371 of the recording heads 36 in the specific width direction D21.

The bent portion 863 is disposed along the inclined portion 857 of the base body 85 when the covering portion 862 is joined with the joint surface 851 of the base body 85. The bent portion 863 continues from the covering portion 862 and is inclined upward with respect to the first cleaning liquid supply surface 865. The lower surface of the bent portion 863 is a first inclined surface 866 (an example of the inclined surface of the present disclosure) that continues from the first cleaning liquid supply surface 865.

Meanwhile, in a case where a cleaning liquid supply port is provided in an ink ejection surface of a recording head, it is necessary to provide a cleaning liquid flow path for supplying the cleaning liquid in the recording head, in addition to an ink flow path for supplying the ink. As a result, a recording head in which a cleaning liquid supply port is provided in an ink ejection surface, has a complicated configuration and is large in size. On the other hand, in the recording apparatus X1 according to the embodiment of the present disclosure, the first cleaning liquid supply ports 834 are formed in the first cleaning liquid supplying portions 83 that are formed independently of the recording heads 36. The recording apparatus X1 as such can clean the ink ejection surfaces 361 with a simple configuration while suppressing an increase in size of the recording heads 36. In addition, in the first cleaning liquid supplying portions 83, the protruding portion 861 covers the lower ends 362 of the side surfaces of the recording head 36 and the main body portion 864. As a result, in a case where the wiper members 821 are moved from the first cleaning liquid supplying portions 83 toward the second cleaning liquid supplying portions 84, it is possible to suppress the first cleaning liquid 831 and the like from entering into a gap between the recording head 36 and the main body portion 864. This makes it possible to suppress contamination of the ink ejection surfaces 361 by contaminants such as the first cleaning liquid 831 that has entered a gap between the recording head 36 and the main body portion 864.

Figure 15:
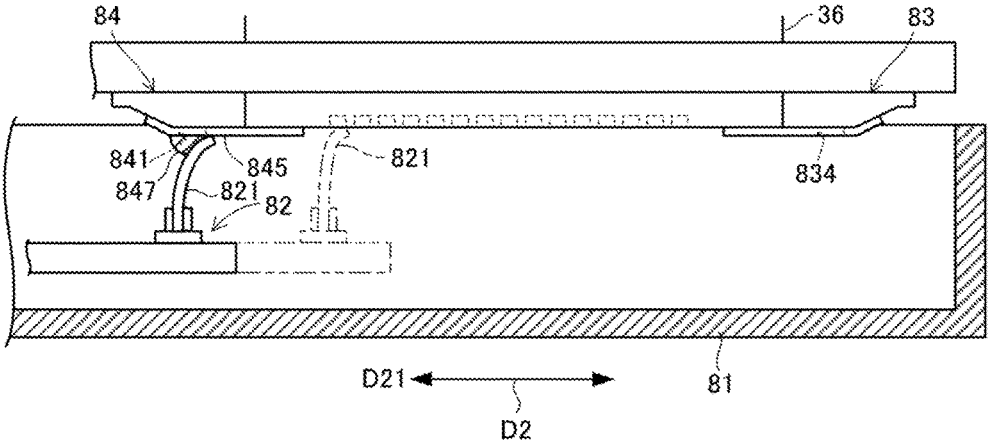
FIG. 15 is a partially broken side view for explaining an operation of the cleaning device.

The plurality of second cleaning liquid supplying portions 84 shown in FIG. 7 supply a second cleaning liquid 841 that is used to clean the wiper members 821 when the wiper members 821 clean the ink ejection surfaces 361 (see FIG. 15). In the present embodiment, the second cleaning liquid 841 is supplied independently of the first cleaning liquid 831 from the cleaning liquid holding portion 872 to the second cleaning liquid supplying portions 84 via tubes 873. That is, the second cleaning liquid 841 and the first cleaning liquid 831 have the same composition. In addition, a pump (not shown) and a switching valve (not shown) are provided in the tube 873 so that the second cleaning liquid 841 can be supplied independently of the first cleaning liquid 831 to the second cleaning liquid supplying portions 84. It is noted that as is the case with the first cleaning liquid 831, when cleaning of the ink ejection surfaces 361 is not being performed, a concave meniscus is formed in each of second cleaning liquid nozzles 842. In addition, the second cleaning liquid 841 may have a different composition from the first cleaning liquid 831.

The basic configuration of the second cleaning liquid supplying portions 84 is the same as that of the first cleaning liquid supplying portions 83, and each of the second cleaning liquid supplying portions 84 includes a main body portion 843 and a protruding portion 844.

The main body portion 843 is disposed on the downstream side of a corresponding recording head 36 in the specific width direction D21. The main body portion 843 includes a second cleaning liquid supply surface 845 and a second inclined surface 846. The second cleaning liquid supply surface 845A is provided with the second cleaning liquid supply port 847 through which the second cleaning liquid for cleaning the wiper members 821 is supplied. That is, the second cleaning liquid supply port 847 is provided on the downstream side of the first cleaning liquid supply port 834 and the ink ejection surface 361 in the specific width direction D21. The protruding portion 844 protrudes from a lower end of the main body portion 843 toward the upstream in the specific width direction D21, and covers, from below, lower ends of side surfaces of the recording head 36 and the main body portion 843 that face each other in the width direction D2.

Meanwhile, in a case where an ink ejection surface is wiped by a cleaning member (a wiper member), the cleaning member may be contaminated with the ink wiped off from the ink ejection surface, and the cleaning performance of the cleaning member may be deteriorated. On the other hand, in the recording apparatus X1 according to the embodiment of the present disclosure, the wiper members 821 are cleaned with the second cleaning liquid 841 supplied from the second cleaning liquid supply port 847 (FIG. 15). As a result, the recording apparatus X1 can suppress deterioration of the cleaning performance due to contamination of the wiper members 821.

Next, a cleaning operation for cleaning the ink ejection surfaces 361 is described. Usually, the cleaning operation is performed after a purging operation. In the following, the purging operation is described prior to the description of the cleaning operation. It is noted that the cleaning operation and the purging operation are performed when the control portion 10 shown in FIG. 1 causes a CPU to execute a predetermined control program stored in a ROM.

The purging operation is performed to restore the recording heads 36. In the purging operation, first, as shown in FIG. 2 and FIG. 4, the control portion 10 drives the lifting/lowering mechanism 6 so as to lower the conveyance unit 5 to the maintenance position, and drives the first moving mechanism so as to move the ink tray 81 of the cleaning device 8 from the first retracted position to a space generated between the line heads 31 to 34 and the conveyance unit 5.

Figure 11:
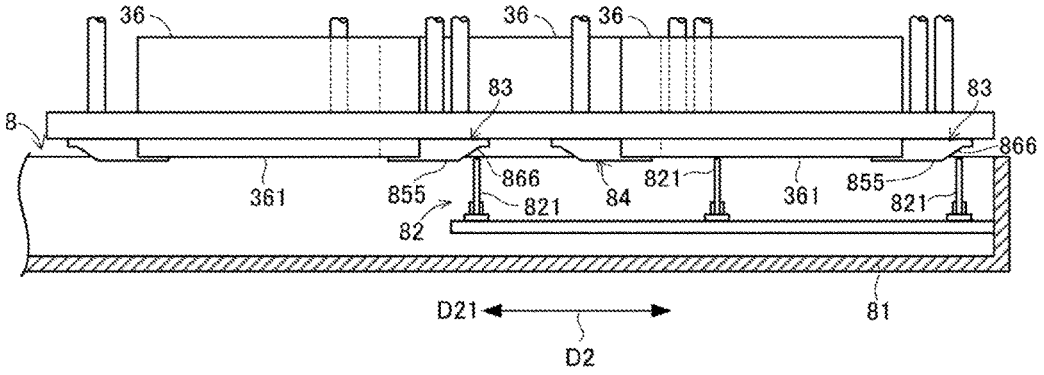
FIG. 11 is a partially broken side view for explaining an operation of the cleaning device.

Subsequently, as shown in FIG. 1, FIG. 2 and FIG. 11, the control portion 10 drives the lifting/lowering mechanism 6 so as to lift the conveyance unit 5 from the maintenance position by a predetermined distance, and dispose the ink tray 81 at the purging position that is directly below the ink ejection surfaces 361. With this operation, the plurality of wiper members 821 of the cleaning device 8 are respectively positioned directly below the first inclined surfaces 866 of the first cleaning liquid supplying portions 83 that are adjacent to the corresponding recording heads 36. At this time, tips of the plurality of wiper members 821 are positioned higher than a plane that includes the first cleaning liquid supply surface 865. The position of the wiper members 821 in the state where the tips thereof are directly below the first inclined surfaces 866 and higher than a plane that includes the first cleaning liquid supply surface 865, is a movement start position from which the wiper members 821 start moving in the cleaning operation.

Figure 12:
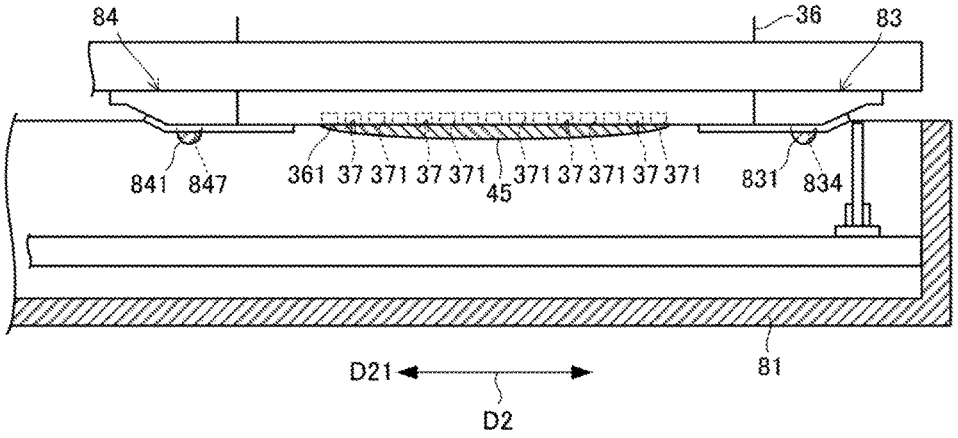
FIG. 12 is a partially broken side view for explaining an operation of the cleaning device.

As shown in FIG. 12, in the above-described state, the control portion 10 supplies purging ink 45 to the recording heads 36, and causes the purging ink 45 to be discharged from the ink ejection ports 371 of the ink nozzles 37. This allows viscous ink, foreign substances, air bubbles and the like to be discharged from the inside of the ink nozzles 37 to the ink tray 81, together with the purging ink 45 supplied to the ink nozzles 37. With such a purging operation, clogging of the ink nozzles 37 is eliminated. It is noted that the ink and the like discharged to the ink tray 81 are discharged from a discharge port provided in the bottom portion of the ink tray 81, to a predetermined waste ink storage portion via an ink tube (not shown).

After the purging operation ends, the cleaning device 8 performs the cleaning operation. The cleaning operation is performed to wipe off the purging ink 45 adhered to the ink ejection surfaces 361. In the cleaning operation, first, the control portion 10 supplies the first cleaning liquid 831 such that the first cleaning liquid 831 projects, in a semispherical shape, from the first cleaning liquid supply ports 834 of the first cleaning liquid supplying portions 83. In addition, the control portion 10 supplies the second cleaning liquid 841 such that the second cleaning liquid 841 projects, in a semispherical shape, from the second cleaning liquid supply ports 847 of the second cleaning liquid supplying portions 84. It is noted that the supply of the second cleaning liquid 841 may be performed after the supply of the first cleaning liquid 831. In addition, the supply of the first cleaning liquid 831 and the second cleaning liquid 841 may be performed simultaneously with or before the discharge of the purging ink 45.

Figure 13:
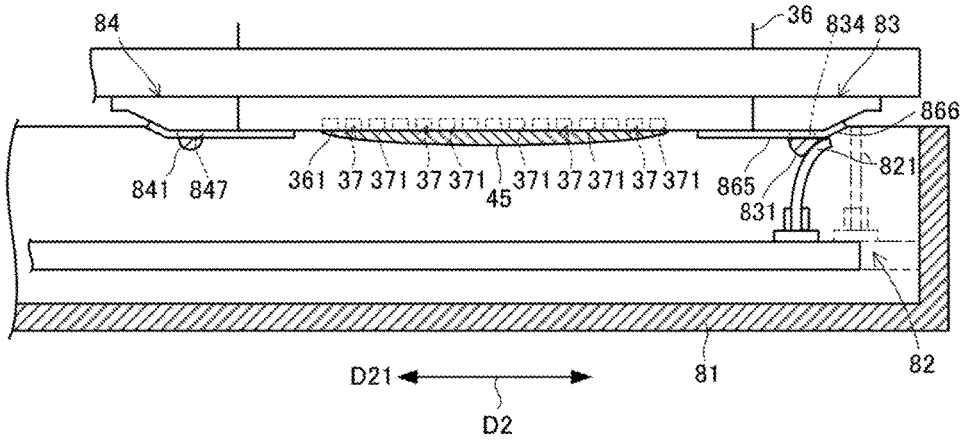
FIG. 13 is a partially broken side view for explaining an operation of the cleaning device.
Figure 14:
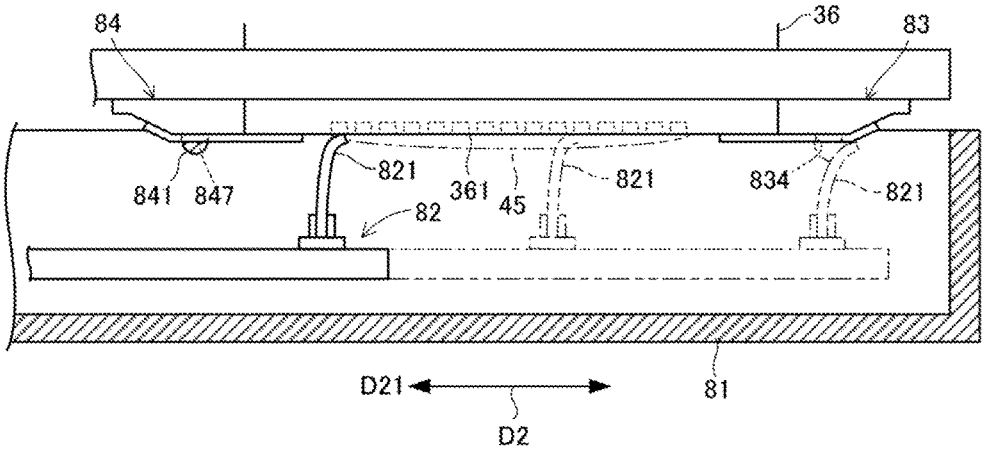
FIG. 14 is a partially broken side view for explaining an operation of the cleaning device.

As shown in FIG. 13 to FIG. 15, after the supply of the first cleaning liquid 831 is completed, the control portion 10 drives the second moving mechanism so as to move the wiper unit 82 horizontally in the specific width direction D21. Specifically, the control portion 10 moves the wiper members 821 from the movement start position to a predetermined intermediate stop position, and stops the wiper members 821 at the intermediate stop position. During this movement, the wiper members 821 move while in contact with the first inclined surfaces 866, the first cleaning liquid supply ports 834, the ink ejection surfaces 361, and the second cleaning liquid supply ports 847.

As shown in FIG. 13, after the plurality of wiper members 821 start moving from the movement start position, a tip portion of each wiper member 821 is curved by coming into contact with the first inclined surface 866 of the first cleaning liquid supplying portion 83, and each wiper member 821 moves while in contact with the first cleaning liquid supply surface 865 while its tip portion is curved. This allows the first cleaning liquid 831 supplied from the first cleaning liquid supply port 834 to be moved toward the ink ejection surface 361 by the wiper member 821. In addition, since the first inclined surface 866 comes into contact with the wiper members 821 first, it is possible to reduce the load that acts on the wiper member 821 when the wiper member 821 moves from the movement start position. This makes it possible to reduce the deterioration with time of the wiper members 821.

In addition, as shown in FIG. 14, the plurality of wiper members 821 wipe off the purging ink 45 adhered to the ink ejection surfaces 361 when they move while in contact with the ink ejection surfaces 361. The residual ink and the like wiped off by the plurality of wiper members 821 move downward along the surfaces of the wiper members 821 together with the first cleaning liquid 831, and drop onto the ink tray 81.

Subsequently, as shown in FIG. 15, when the plurality of wiper members 821 are stopped at the intermediate stop position, the wiper members 821 are cleaned by the second cleaning liquid 841. Here, at the intermediate stop position, the tip portions of the wiper members 821 come into contact with the second cleaning liquid 841 projecting, in a semispherical shape, from the second cleaning liquid supply ports 847. In the case where the wiper members 821 are stopped at the intermediate stop position, compared to a case where the wiper members 821 are moved along the second cleaning liquid supply ports 847, the cleaning efficiency of cleaning the wiper members 821 is increased. In addition, the supply of the second cleaning liquid 841 may be continued while the wiper members 821 are stopped at the intermediate stop position. This further increases the cleaning efficiency of the wiper members 821.

Figure 16:
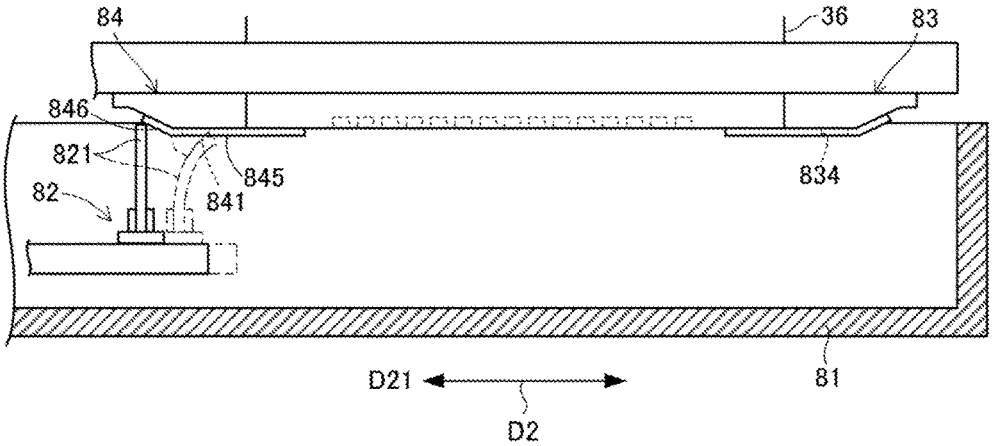
FIG. 16 is a partially broken side view for explaining an operation of the cleaning device.

As shown in FIG. 16, when the cleaning of the wiper members 821 at the intermediate stop position, the control portion 10 drives the second moving mechanism so as to move the wiper unit 82 horizontally along the specific width direction D21. Specifically, the control portion 10 moves the wiper members 821 from the intermediate stop position to a cleaning end position, and stops the wiper members 821 at the cleaning end position. The position of the wiper members 821 in a state where the tips thereof are directly below the second inclined surfaces 846 and higher than a plane that includes the second cleaning liquid supply surface 845, is a movement end position at which the wiper members 821 stop moving in the cleaning operation.

Figure 17:
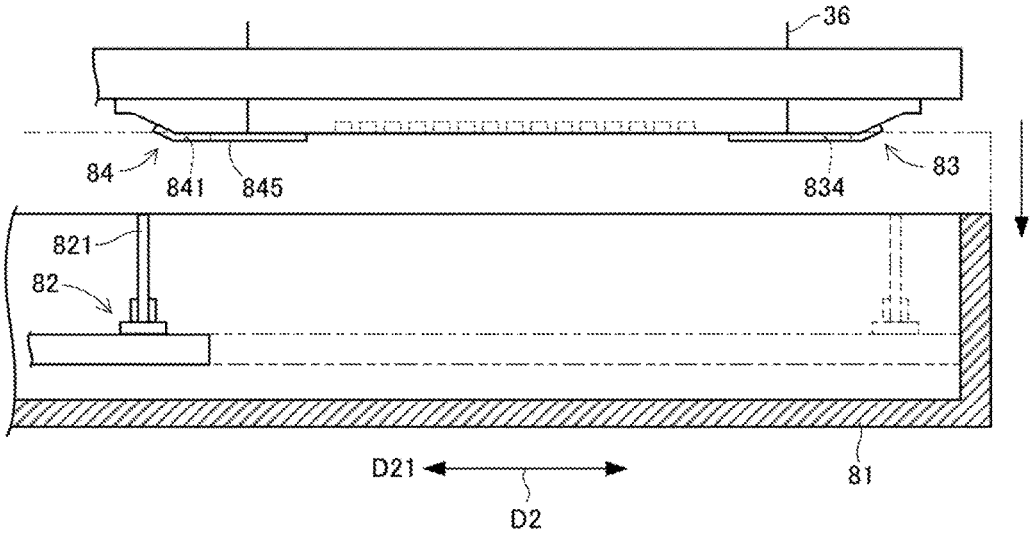
FIG. 17 is a partially broken side view for explaining an operation of the cleaning device.

Subsequently, as shown in FIG. 17, the control portion 10 drives the lifting/lowering mechanism 6 (see FIG. 1 and FIG. 2) so as to lower the conveyance unit 5 to the maintenance position, and drives the first moving mechanism so as to return the ink tray 81 of the cleaning device 8 to the first retracted position. In addition, the control portion 10 drives the lifting/lowering mechanism 6 so as to return the conveyance unit 5 to the recording position (the position shown in FIG. 1).

It is noted that the cleaning operation may be performed a plurality of times per purging operation. In addition, the number of times that the cleaning operation is performed per purging operation may be determined based on the environmental temperature, the environmental humidity, or the time period for which the main power source of the recording apparatus X1 has been turned off. For example, in a high-temperature environment and/or a low-humidity environment where the ink drying speed is high and the thickening property of the ink is apt to become high, and/or when the main power source has been turned off for a long time period, the cleaning operation may be performed two or three times per purging operation. In addition, when the main power source is turned on, it is preferable that the purging operation and the cleaning operation are executed after a predetermined time elapses since the power-on of the main power source before the printing is started.

Figure 18:
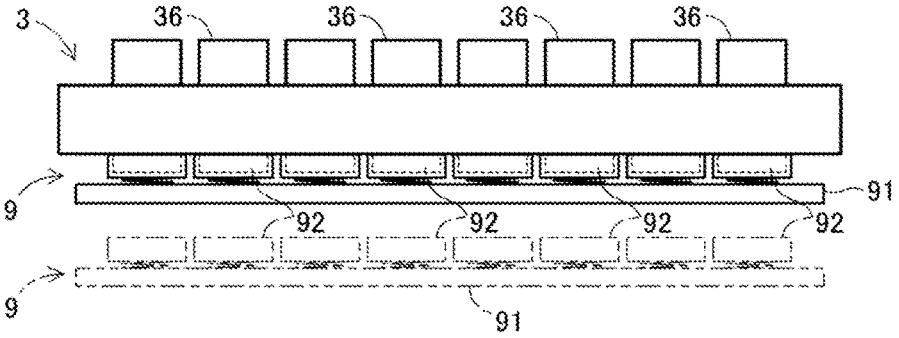
FIG. 18 is a front view showing a state where cap portions of a cap device are attached to recording heads, the first cleaning liquid supplying portion and the second cleaning liquid supplying portion.
Figure 19:
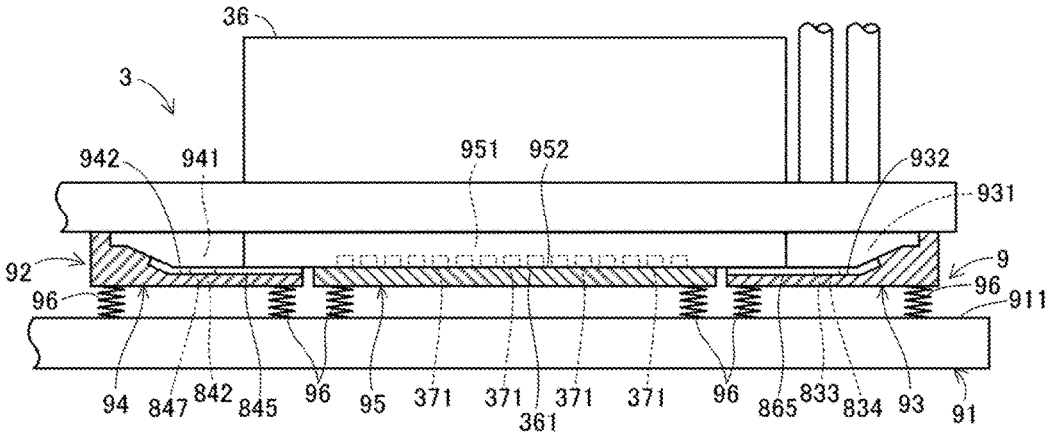
FIG. 19 is a partially broken side view showing a state where the cap portions are attached to the recording heads, the first cleaning liquid supplying portion and the second cleaning liquid supplying portion.
Figure 20:
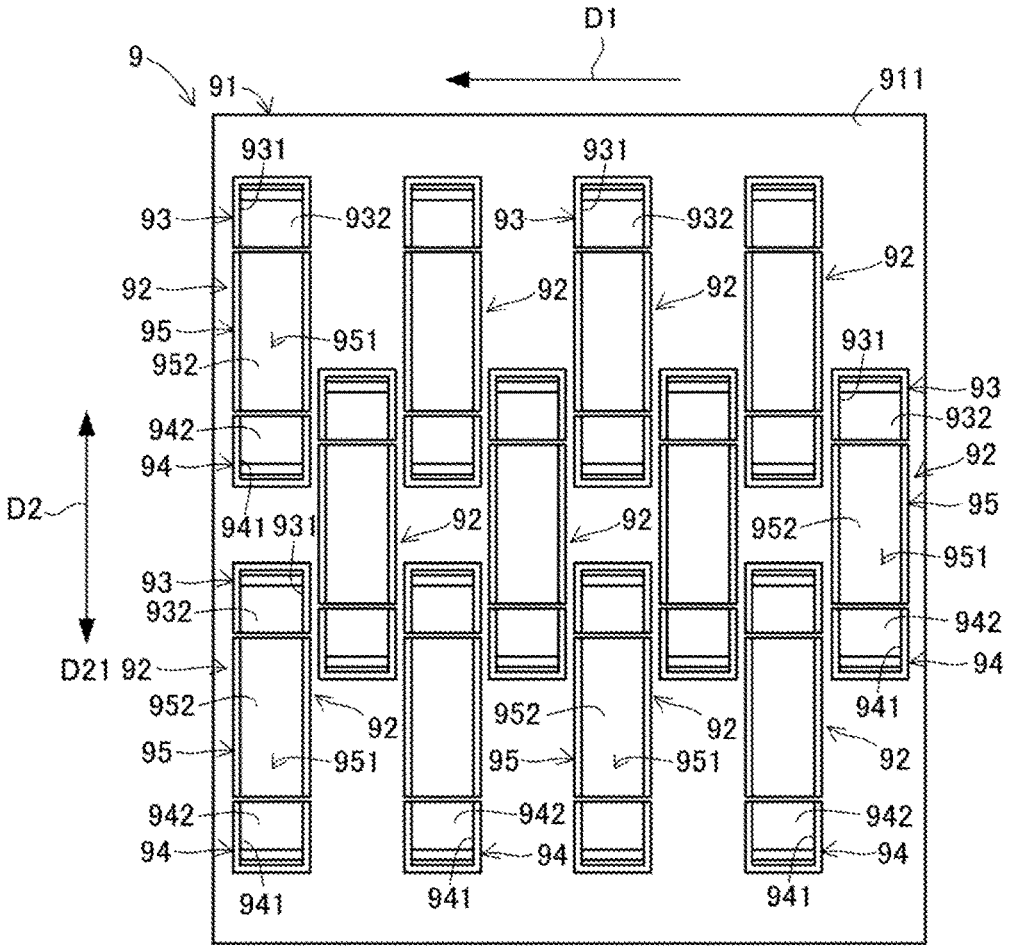
FIG. 20 is a plan view showing a configuration of the cap device.

As shown in FIG. 18 to FIG. 20, the cap device 9 is provided to prevent the first cleaning liquid 831 (see FIG. 8) in the first cleaning liquid nozzles 833, the second cleaning liquid in the second cleaning liquid nozzles 842 (see FIG. 19), and the ink in the ink nozzles 37 from drying, by covering the first cleaning liquid supply ports 834 of the first cleaning liquid supply surfaces 865, the second cleaning liquid supply ports 847 of the second cleaning liquid supply surfaces 845, and the ink ejection ports 371 of the ink ejection surfaces 361. The cap device 9 includes a plurality of cap units 92 supported by a carriage 91.

Twelve cap units 92 are disposed at positions respectively corresponding to the recording heads 36. Each of the plurality of cap units 92 includes a first cap portion 93 (an example of the cleaning liquid cap portion of the present disclosure), a second cap portion 94, a third cap portion 95 (an example of the ink cap portion of the present disclosure), and a plurality of coil springs 96. The cap portions 93 to 95 are formed separately from each other, from a rubber material such as ethylene propylene diene rubber (EPDM), butyl rubber (IIR), or silicone rubber so as to have rubber elasticity.

Figure 21:
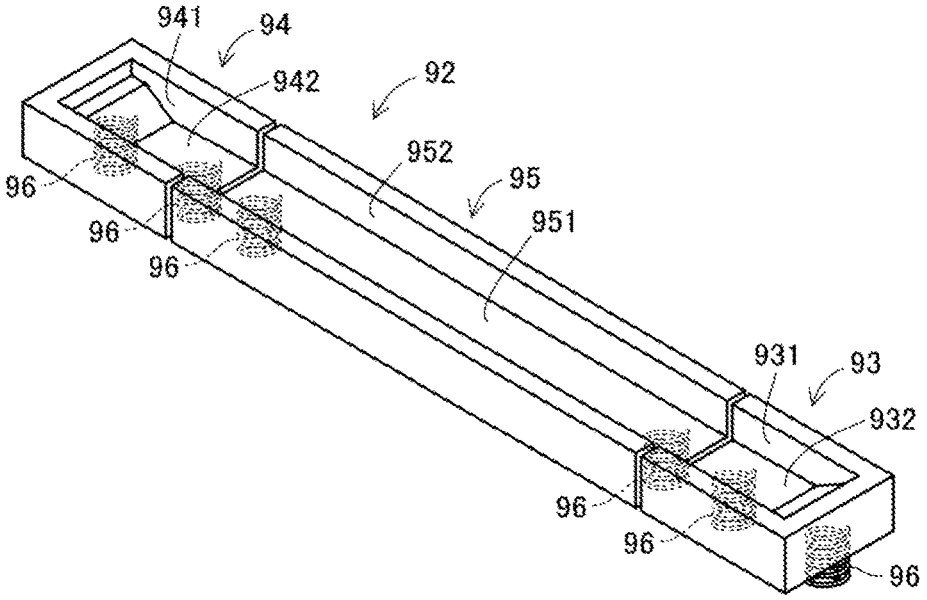
FIG. 21 is a perspective view of a cap unit.

As shown in FIG. 19 to FIG. 21, the first cap portion 93 closes the first cleaning liquid supply port 834 by covering it. The first cap portion 93 includes a concave portion 931 whose shape resembles the outer shape of the first cleaning liquid supplying portion 83. A bottom surface 932 of the concave portion 931 is supported on an upper surface 911 of the carriage 91 via the plurality of coil springs 96 fixed to the upper surface 911 of the carriage 91. With this configuration, the first cap portion 93 is biased upward when it covers the first cleaning liquid supply port 834, thereby the adhesion of the bottom surface 932 to the first cleaning liquid supply surface 865 is improved. In addition, since the first cap portion 93 has a rubber elasticity, the adhesion of the bottom surface 932 to the first cleaning liquid supply surface 865 is further improved. In this way, by improving the adhesion of the bottom surface 932 to the first cleaning liquid supply surface 865, it is possible to suitably maintain the closing property of the first cleaning liquid supply port 834 by the bottom surface 932. In addition, since the concave portion 931 has a shape resembling the outer shape of the first cleaning liquid supplying portion 83, it is possible to maintain the closing property of the first cleaning liquid supply port 834 more suitably.

The second cap portion 94 closes the second cleaning liquid supply port 847 by covering it. The second cap portion 94 includes a concave portion 941 whose shape resembles the outer shape of the second cleaning liquid supplying portions 84. A bottom surface 942 of the concave portion 941 is configured to cover the second cleaning liquid supply port 847. The second cap portion 94 is supported on the upper surface 911 of the carriage 91 via the plurality of coil springs 96 fixed to the upper surface 911 of the carriage 91. With this configuration, for the same reason as that for the first cap portion 93, the second cap portion 94 improves the adhesion of the bottom surface 942 to the second cleaning liquid supply surface 845, and suitably maintains the closing property of the second cleaning liquid supply port 847 by the bottom surface 942.

The third cap portion 95 closes the ink ejection port 371 by covering it. The third cap portion 95 is elongated in the width direction D2, and includes a concave portion 951. The concave portion 951 extends in the width direction D2, and has a rectangular shape in a cross section. The size of the concave portion 951 along the conveyance direction D1 corresponds to a size of the recording head 36 along the conveyance direction D1. In addition, a bottom surface 952 of the concave portion 951 is configured to cover the ink ejection port 371, and extends in the width direction D2. The third cap portion 95 is supported on the upper surface 911 of the carriage 91 via the plurality of coil springs 96 fixed to the upper surface 911 of the carriage 91. With this configuration, the third cap portion 95 is biased upward when it covers the ink ejection port 371, thereby the adhesion of the bottom surface 952 to the ink ejection surfaces 361 is improved. In addition, since the third cap portion 95 has a rubber elasticity, the adhesion of the bottom surface 952 to the ink ejection surfaces 361 is further improved. In this way, by improving the adhesion of the bottom surface 952 to the ink ejection surfaces 361, it is possible to suitably maintain the closing property of the ink ejection port 371 by the bottom surface 952. In addition, since the size of the concave portion 951 along the conveyance direction D1 corresponds to the size of the recording head 36 along the conveyance direction D1, it is possible to maintain the closing property of the ink ejection port 371 more suitably.

It is noted that the cap portions 93 to 95 may be supported on the upper surface 911 of the carriage 91 via another elastic member such as a plate spring or a rubber elastic member, instead of the coil springs 96.

The carriage 91 is configured to move the cap portions 93 to 95 in the horizontal direction (in the left-right direction in FIG. 1) and in the vertical direction (in the up-down direction in FIG. 1), and is supported so as to move reciprocally in the horizontal direction and the vertical direction. The carriage 91 is configured to move in the horizontal direction by the third moving mechanism. As is the case with the first moving mechanism, the third moving mechanism is a well-known drive mechanism that moves the carriage 91 in the horizontal direction by using, for example, a rack and pinion mechanism that converts a rotary motion of a gear coupled with a rotation shaft of a motor to a linear motion. It is noted that it is possible to adopt a configuration where the third moving mechanism is not provided, and the first moving mechanism moves the ink tray 81 and the carriage 91 selectively. In addition, the carriage 91 can be lifted and lowered in the vertical direction. When the carriage 91 is moved to a position below the line heads 31 to 34, the carriage 91 is lifted as the conveyance unit 5 is lifted from the maintenance position by the lifting/lowering mechanism 6 by a predetermined distance.

Here, since the cap portions 93 to 95 are supported by the cap units 92, the first cap portions 93 to 95 can move in the horizontal direction and the vertical direction. As a result, by moving the carriage 91 horizontally from a second retracted position to the position below the line heads 31 to 34 and then lifting the carriage 91 upward, it is possible to cause the cap portions 93 to 95 to cover the ink ejection port 371 and the cleaning liquid supply ports 834 and 847. That is, it is possible to cause the first cap portion 93 to cover the first cleaning liquid supply port 834, cause the second cap portion 94 to cover the second cleaning liquid supply port 847, and cause the third cap portion 95 to cover the ink ejection port 371. On the other hand, in the state where the ink ejection port 371 and the cleaning liquid supply ports 834 and 847 are covered with the cap portions 93 to 95, it is possible to drive the second moving mechanism so as to lower the carriage 91 and thereby remove the cap portions 93 to 95 from the ink ejection port 371 and the cleaning liquid supply ports 834 and 847. In addition, when the cap portions 93 to 95 are removed from the ink ejection port 371 and the cleaning liquid supply ports 834 and 847, the carriage 91 is moved horizontally by the third moving mechanism, and returned to the second retracted position.

Figure 22:
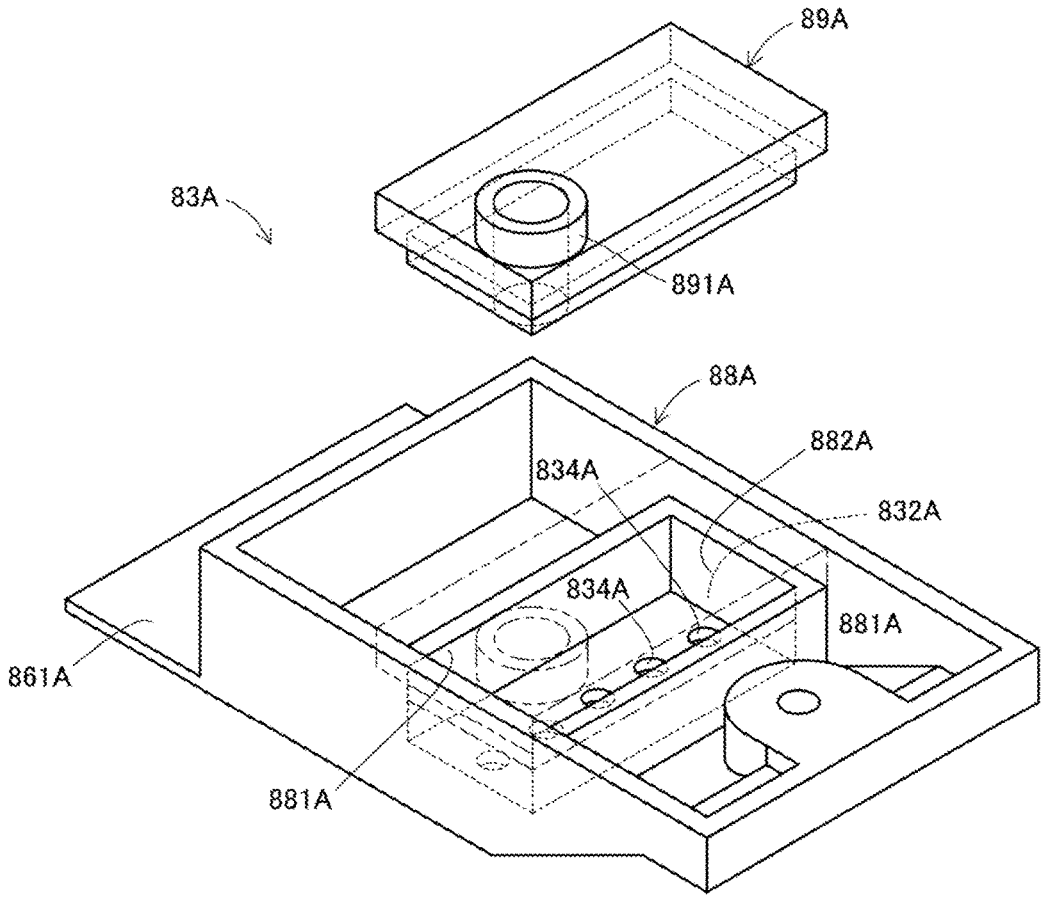
FIG. 22 is a disassembled perspective view showing another example of the first cleaning liquid supplying portion.

In the above-described embodiment, each of the first cleaning liquid supplying portions 83 includes the base body 85 and the plate-like member 86. However, the present disclosure is not limited to this configuration. For example, the first cleaning liquid supplying portions 83 may be replaced with first cleaning liquid supplying portions 83A shown in FIG. 22. As shown in FIG. 22, each of the first cleaning liquid supplying portions 83A may include a base body 88A (an example of the first member of the present disclosure) that includes a protruding portion 861A and first cleaning liquid supply ports 834A. In addition, the base body 88A includes a concave portion 882A having an upper opening 881A. The upper opening 881A is closed by a cover 89A (an example of the second member of the present disclosure) on which a joint 891A is formed. With this configuration, a storage space 832A for storing the first cleaning liquid is formed by the concave portion 882A of the base body 88A and the cover 89A. It is noted that the second cleaning liquid supplying portions 84 may be modified in the same manner as the first cleaning liquid supplying portions 83.

Figure 23:
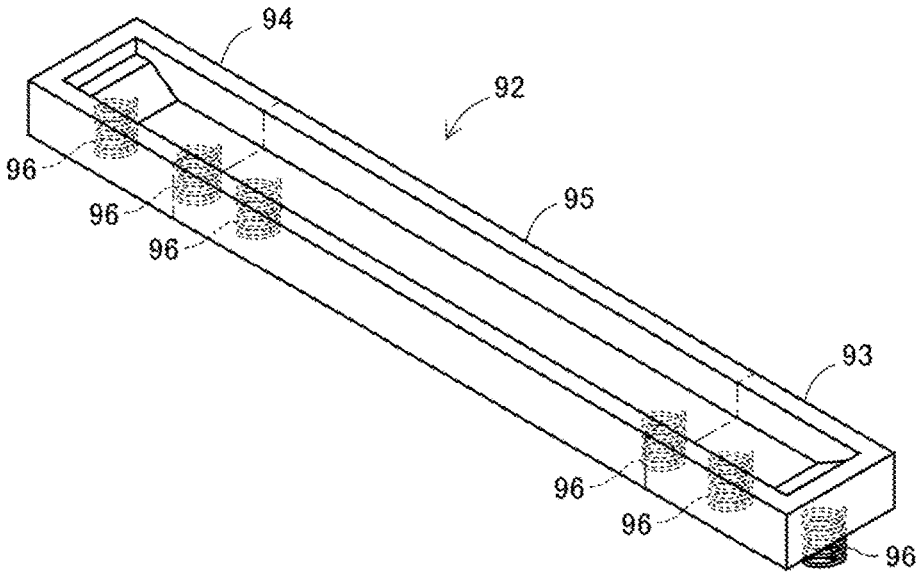
FIG. 23 is a disassembled perspective view showing another example of the cap unit.

In the above-described embodiment, the cap unit 92 includes the first cap portion 93, the second cap portion 94, and the third cap portion 95 as separate members. However, as shown in FIG. 23, the cap unit 92 may be integrally formed from the first cap portion 93, the second cap portion 94, and the third cap portion 95.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An inkjet recording apparatus comprising:

an ink ejection surface having an ink ejection port through which ink is ejected;

a cleaning liquid nozzle which has a cleaning liquid supply port through which cleaning liquid for cleaning the ink ejection surface is supplied, and in which a concave meniscus is formed on a surface of the cleaning liquid;

a storage space storing the cleaning liquid and communicated with an inside of the cleaning liquid nozzle; and a porous member disposed in the storage space.

2. The inkjet recording apparatus according to claim 1, wherein the porous member is a mesh sheet.

3. The inkjet recording apparatus according to claim 2, wherein an average mesh diameter of the mesh sheet is 10 μm or larger and 100 μm or smaller.

4. The inkjet recording apparatus according to claim 2, wherein a plurality of the mesh sheets are disposed in the storage space, and the plurality of the mesh sheets are stacked in a thickness direction of the mesh sheets.

5. The inkjet recording apparatus according to claim 1, further comprising:

a cleaning liquid cap portion configured to close the cleaning liquid supply port by covering the cleaning liquid supply port.

6. The inkjet recording apparatus according to claim 5, further comprising:

an ink cap portion configured to close the ink ejection port by covering the ink ejection port.

7. The inkjet recording apparatus according to claim 6, wherein the ink cap portion is separate from the cleaning liquid cap portion.

8. The inkjet recording apparatus according to claim 1, further comprising:

a cleaning member configured to clean the ink ejection surface by the cleaning liquid by moving while in contact with the ink ejection surface;

a cleaning liquid supply surface in which the cleaning liquid supply port is formed; and an inclined surface provided on an upstream side of the cleaning liquid supply surface in a moving direction of the cleaning member, continuing from the cleaning liquid supply surface, and inclined upward with respect to the cleaning liquid supply surface, wherein before the cleaning member starts to be moved along the moving direction, a tip of the cleaning member is disposed at a predetermined movement start position that is set in a region located directly below the inclined surface and in a region located higher than a plane that includes the cleaning liquid supply surface.

9. The inkjet recording apparatus according to claim 8, further comprising:

a recording head having the ink ejection port; and a cleaning liquid supplying portion having the cleaning liquid supply port and disposed on an upstream side of the recording head in the moving direction.

10. An inkjet recording apparatus comprising:

an ink election surface having an ink ejection port through which ink is ejected; and a cleaning liquid nozzle which has a cleaning liquid supply port through which cleaning liquid for cleaning the ink election surface is supplied, and in which a concave meniscus is formed on a surface of the cleaning liquid, wherein an internal diameter of the cleaning liquid nozzle is 10 μm or larger and 100 μm or smaller.

* * * * *